US006991306B2

(12) United States Patent
Swenson et al.

(10) Patent No.: US 6,991,306 B2
(45) **Date of Patent: *Jan. 31, 2006**

(54) CARROUSEL FILE

(75) Inventors: David C. Swenson, Spring Lake, MI (US); Gary L. Kersting, Sr., Twin Lake, MI (US)

(73) Assignee: Harbor Steel & Supply Corp., Muskegon, MI (US)

( * ) Notice: Subject to any disclaimer, the term of this patent is extended or adjusted under 35 U.S.C. 154(b) by 129 days.

This patent is subject to a terminal disclaimer.

(21) Appl. No.: 10/231,959

(22) Filed: Aug. 30, 2002

(65) Prior Publication Data

US 2004/0041501 A1 Mar. 4, 2004

(51) Int. Cl.
*A47B 81/00* (2006.01)

(52) U.S. Cl. ..... 312/305; 312/285

(58) Field of Classification Search ..... 312/125, 312/135, 305, 270.1, 270.2, 270.3, 249.2, 312/249.3, 285, 283; 108/94, 103, 139, 140; 211/144, 163; 220/23.83

See application file for complete search history.

(56) References Cited

U.S. PATENT DOCUMENTS

| | | | | | |
|---|---|---|---|---|---|
| 197,925 | A | * | 12/1877 | Danner | 108/103 |
| 253,757 | A | * | 2/1882 | Pearce | 108/103 |
| 256,600 | A | * | 4/1882 | Schell | 108/94 |
| 264,747 | A | | 9/1882 | Potts | |
| 405,003 | A | | 6/1889 | Blackledge | |
| 471,357 | A | | 3/1892 | Grundy | |
| 503,306 | A | | 8/1893 | Bever | |
| 589,463 | A | | 9/1897 | Case | |
| 593,636 | A | | 11/1897 | Bamberger | |
| 827,761 | A | | 8/1906 | Stromgren | |
| 1,027,701 | A | | 5/1912 | Deming | |
| 1,054,311 | A | | 2/1913 | Phillips | |
| 1,141,271 | A | * | 6/1915 | Skall | 312/310 |
| 1,258,425 | A | * | 3/1918 | Mcmaster | 108/103 |
| 1,291,296 | A | | 1/1919 | Waite | |
| 1,423,538 | A | | 7/1922 | Ozabal | |
| 1,600,830 | A | | 9/1926 | Lewis | |
| 1,763,724 | A | | 6/1930 | Rosenthal | |
| 1,785,666 | A | * | 12/1930 | Bachelder | 312/249.3 |
| 1,918,056 | A | * | 7/1933 | Platt | 108/94 |
| 2,078,338 | A | | 4/1937 | Moore | |
| 2,196,024 | A | | 4/1940 | North | |
| 2,370,474 | A | | 2/1945 | Kraft | |
| 2,530,566 | A | | 11/1950 | Clark | |
| 2,582,421 | A | | 1/1952 | Essman | |
| 2,624,650 | A | | 1/1953 | DePerales | |
| 2,628,880 | A | | 2/1953 | Kader | |
| 2,775,498 | A | | 12/1956 | Gettel | |
| 2,814,542 | A | | 11/1957 | Gleitsman | |
| D201,331 | S | * | 6/1965 | Ullmann | D6/457 |
| 3,195,736 | A | * | 7/1965 | Bomar, Jr. | 211/163 |

(Continued)

FOREIGN PATENT DOCUMENTS

| | | | |
|---|---|---|---|
| GB | 17766 | * | 4/1909 |

*Primary Examiner*—Janet M. Wilkens
(74) *Attorney, Agent, or Firm*—Kane & Co., PLC

(57) ABSTRACT

A file cabinet providing access to files from substantially all sides, and having at least one rotatable tier. Each tier includes a carrousel file support having a plurality of radially extending arms. Mounted to the outer terminus of each arm is a pivot arm assembly, each configured to rotate about a vertical axis between a retracted position and an extended position. Each pivot arm assembly is adapted to suspend a file container thereon to provide detachable storage.

29 Claims, 18 Drawing Sheets

U.S. PATENT DOCUMENTS 3,326,615 A 6/1967 Karper
3,498,471 A 3/1970 Dirkx
3,722,972 A 3/1973 Deeds et al.
3,753,606 A 8/1973 Ozeki
3,820,862 A * 6/1974 Crosslen ..... 312/123
3,844,230 A * 10/1974 Hudson et al. ..... 108/60
3,868,916 A 3/1975 Ohlson
3,876,271 A 4/1975 Skirlock
3,985,409 A 10/1976 Kneier
4,155,477 A 5/1979 Fosher
4,236,771 A 12/1980 Summers
4,239,308 A 12/1980 Bradley
4,317,606 A 3/1982 Hastings
4,418,970 A 12/1983 Hyder et al.
4,433,885 A 2/1984 Baker
4,485,997 A 12/1984 Potter
4,697,856 A 10/1987 Abraham
4,723,819 A 2/1988 Ramberg
4,783,130 A 11/1988 Twellmann
4,796,960 A 1/1989 Malcolm
4,850,658 A 7/1989 Sandor
4,901,867 A 2/1990 Petty, Jr.
4,938,549 A 7/1990 Potter
5,065,872 A 11/1991 Simon
5,101,738 A 4/1992 Sideris
5,176,264 A 1/1993 De Palma
5,281,016 A 1/1994 Brague
5,310,209 A 5/1994 Holman
5,370,255 A 12/1994 Yang
5,423,434 A 6/1995 Chen
5,456,529 A 10/1995 Cheung
5,547,273 A 8/1996 Hudnall
5,669,494 A 9/1997 Geffen
6,588,865 B2 * 7/2003 Caldwell et al. ..... 312/285
2001/0017508 A1 * 8/2001 Caldwell et al. ..... 312/326

* cited by examiner

CARROUSEL FILE

BACKGROUND OF THE INVENTION

1. Field of the Invention

This invention relates generally to filing cabinets, file drawers, storage units and the like, and more particularly to a filing cabinet where more than one drawer may be opened at any one time without fear of the filing cabinet tipping.

2. Discussion of the Related Art

Lateral and vertical filing cabinets typically have drawers extending from one side of the cabinet box frame. To prevent the cabinet from tipping or falling over, the filing cabinet is typically provided with a substantial counterweight at the rear of the box frame to counter the weight of any opened drawer. To prevent an excessive moment-arm or load, an interlock mechanism is usually provided which prevents more than one drawer from opening at a time. Examples of such filing cabinets may be found in the following United States Patents: U.S. Pat. No. 3,969,008; U.S. Pat. No. 4,355,851; U.S. Pat. No. 4,429,930; U.S. Pat. No. 4,480,883; and U.S. Pat. No. 4,711,505.

Vertical filing cabinets have been designed where the drawers do not extend from the cabinet, but are mounted on a track or linkage mechanism to revolve in a vertical oval pattern within the cabinet. These vertical rotary cabinets require complicated mechanisms to permit user access to a single file drawer. Furthermore, these cabinets are almost always preassembled, requiring a substantial amount of shipping and stocking space.

A need exists for a filing cabinet which maximizes the storage space and permits access to more than one filing drawer without fear of the cabinet tipping over. There is also a need for a filing cabinet which can be shipped disassembled and employs standardized components resulting in minimum shipping and inventory space providing low unit cost.

SUMMARY OF THE INVENTION

The instant invention is directed toward a file cabinet which permits access to stored files from all sides of the cabinet. Simultaneously, the design provides a much safer design than that currently offered because the file cabinet is not subject to tipping than previous designs which require complex safety mechanisms to prevent more than one drawer being opened at a time.

According to one form of the invention, a file cabinet assembly is provided, including a base assembly having a centrally disposed upright member. The upper end of the upright member may be configured to receive a top assembly. In its simpler form, a carrousel file support assembly is suspended from the upper end of the upright member such that the carrousel file support assembly rotates freely around the upright member. The base assembly may include a base plate, a plurality of base plate support ribs attached to at least one surface of the base plate, and a plurality of glides attached to said support ribs. The base assembly further includes a center post forming the central upright member where one end extends through and is secured to the base plate, and the opposite end terminating in a threaded rod. A bearing support is concentrically received over the threaded rod and rests on the upper end of the center post. In this embodiment, the carrousel file support assembly may include an upper and a lower spider assemblies spaced apart from each other, and interconnected by a plurality of pivot arm assemblies. Each of the pivot arm assemblies includes an arm extending substantially perpendicular therefrom, and adapted to detachably receive a container for holding documents or other objects. The pivot arm swings about its axis between an extended position for accessing the attached file container, and a retracted or stowed position.

In another form of the invention, the upper and lower spider assemblies each include a spider having a centrally located opening, about which radially extend a plurality of arms. Disposed in the centrally located opening and attached to the spider is a ring member. In the upper spider assembly, the ring member is adapted to receive and rest upon a tapered bearing which facilitates rotation of the carrousel file support. The ring member attached to the lower spider is configured to receive a bushing and is journaled about the lower portion of the centrally disposed upright member.

In yet another form of the invention, each of the plurality of pivot arm assemblies include at least one pivot tube having at least one dimple formed at opposite ends. An end cap is disposed in at least one of the ends. In a multiple tiered design, stacked pivot arm assemblies are interconnected by a connector cap. In either form, a pivot stop assembly is disposed within each pivot tube and interconnect the ends of the arms of the upper and lower spider assemblies.

The advantages provided by the invention include a design which may be used in the home office as well as the business office. The design is inherently stable and permits multiple drawers to be opened at one time. The instant invention provides 360 degrees of accessibility. The rotary tiers enhance access to the different file containers and allow placement of the cabinet against a wall or into a corner. The cabinet also provides a wide range of appearance options. The flexibility of the design also translates into cost savings as the basic building blocks are used to create one, two, three, or four tier designs. Special tooling or parts are not required to produce the various designs. Different from the conventional metal or wood lateral file, the instant invention may include metal or cloth panels in a wide array of colors and patterns. Moreover, each file container may be manufactured from a metal or plastic in a variety of color combinations to provide an aesthetically pleasing appearance.

DETAILED DESCRIPTION OF PREFERRED EMBODIMENT

Figure 1:
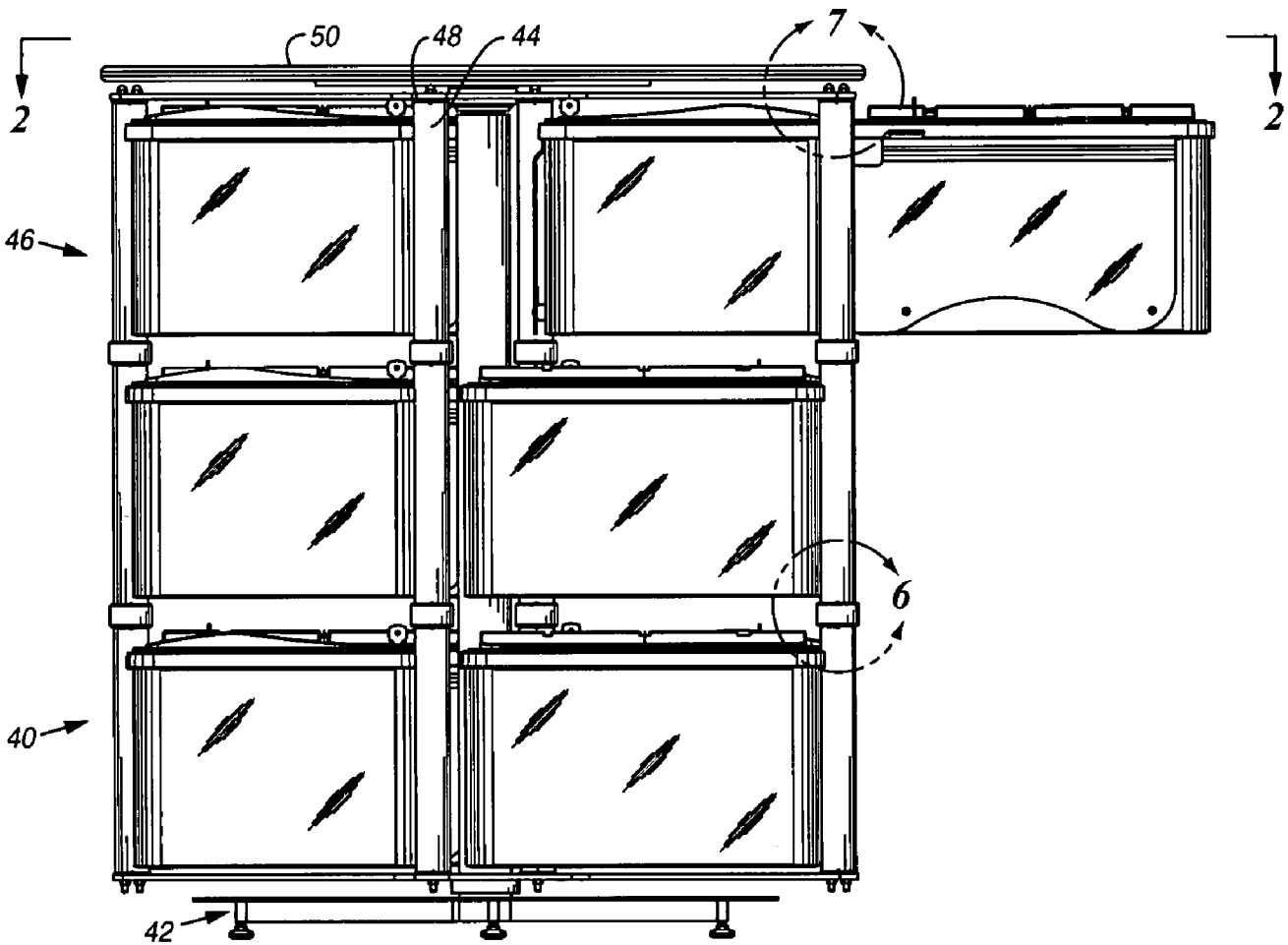
FIG. 1 is an elevation view of a filing cabinet assembly embodying the present invention.

For purposes of the following description, the terms "upper," "lower," "left," "rear," "front," "vertical," "horizontal" and derivatives of such terms shall relate to the invention as oriented in FIG. 1. However, it is to be understood that the invention may assume alternative orientations, except where expressly specified to the contrary. It should also be understood the specific devices and processes illustrated in the attached drawings, and described in the following specification are simply exemplary embodiments of the inventive concepts defined in the appended claims. Specific dimensions and other physical characteristics relating to the embodiments disclosed herein are not to be considered as limiting, unless the claims expressly state otherwise.

Figure 2:
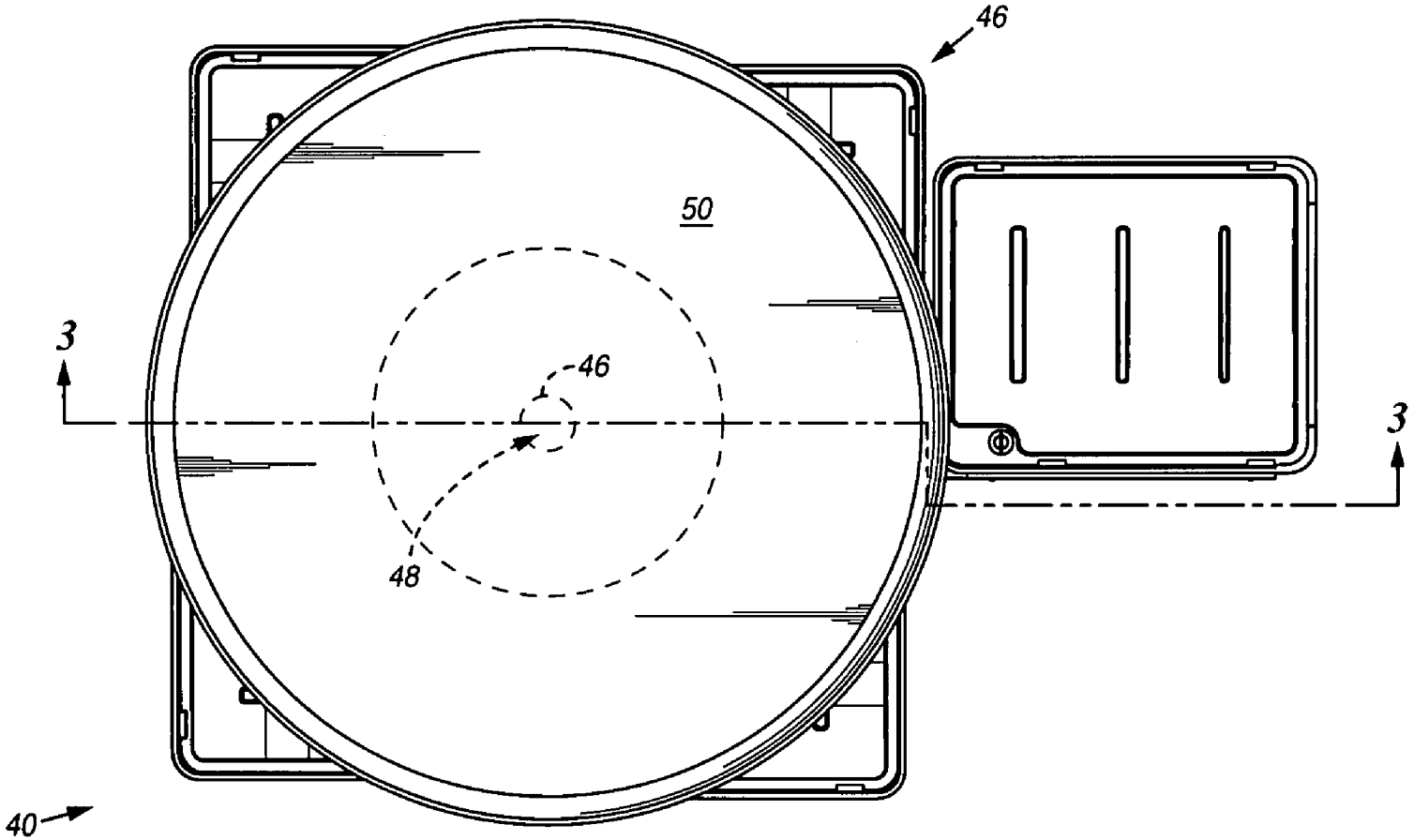
FIG. 2 is a plan view of the filing cabinet assembly shown in FIG. 1.
Figure 3:
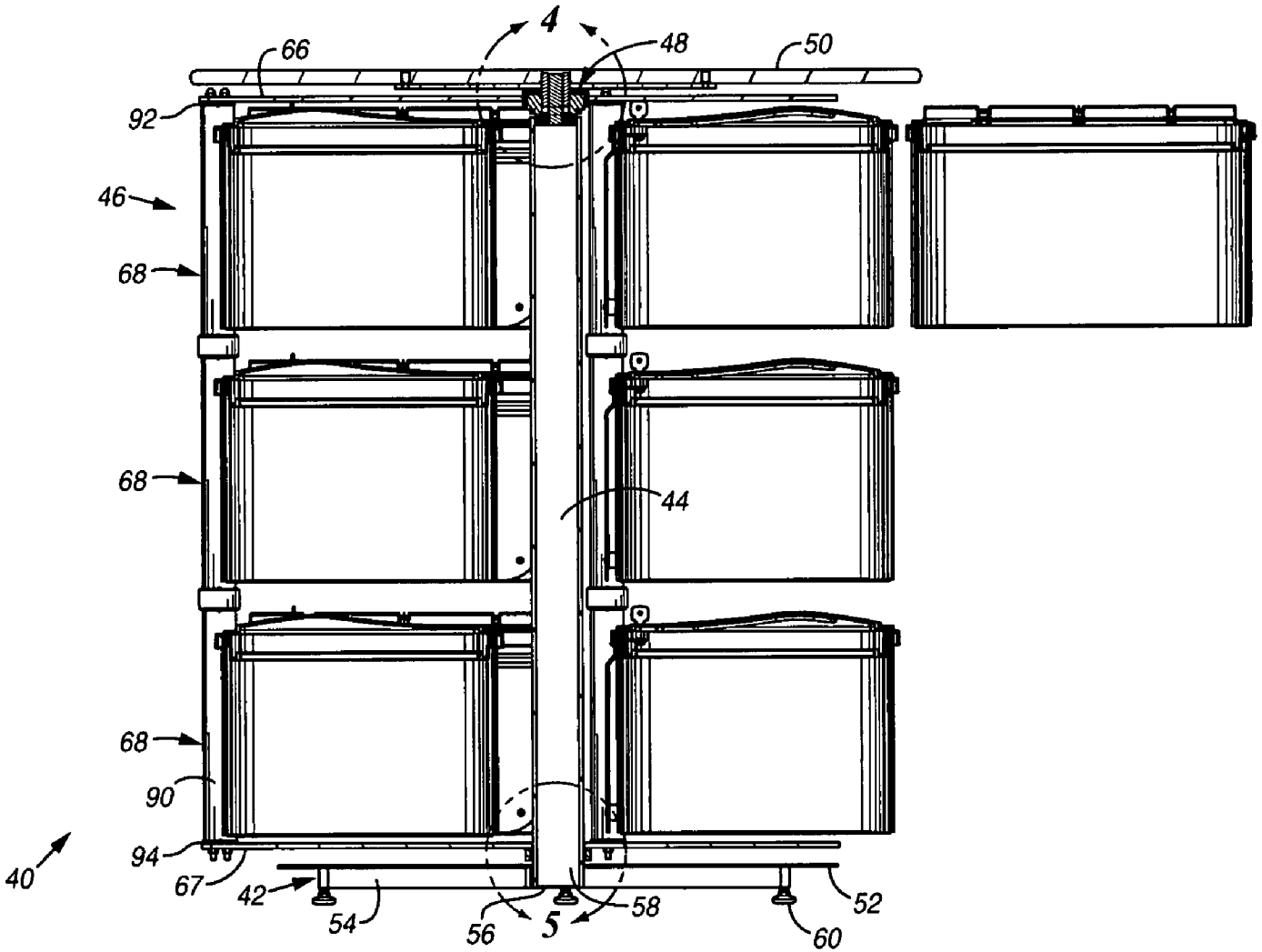
FIG. 3 is a section view of the filing cabinet assembly taken from line 3 —3 shown in FIG. 2.
Figure 5:
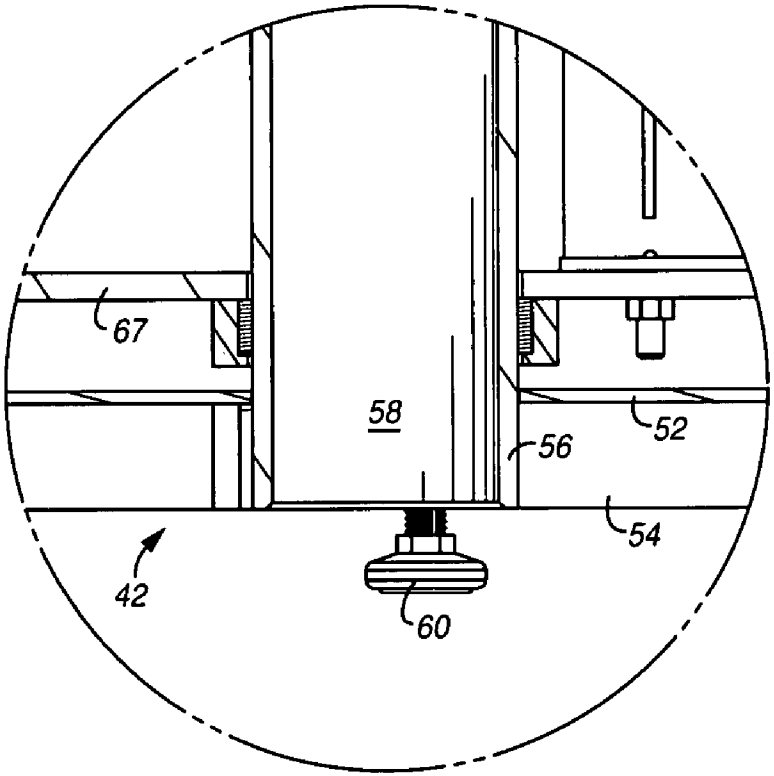
FIG. 5 is an enlarged view of the section shown in circle 5 in FIG. 3.

Referring to the drawing figures, and specifically with reference to FIGS. 1–3, the instant invention is directed to a file cabinet assembly 40 which provides 360 degree access to files suspended thereon, and which rotates the suspended files about a central vertical axis of the file cabinet assembly 40. The invention can be configured to have anywhere from one to five tiers, depending upon the desired configuration. Moreover, file containers may be removed from the lower tiers of the file cabinet assembly 40 without the associated fear of upsetting the balance of the cabinet as exists in current lateral file designs. Moreover, multiple drawers or containers may be accessed simultaneously without fear of tipping as in more conventional lateral cabinet designs.

Referring again to FIGS. 1–3, the file cabinet assembly 40 comprises a base assembly 42 having a centrally disposed upright member or center post 44. Resting on an upper end of the upright member 44, and concentrically receiving the upright member 44 is a carrousel file support assembly 46. As will be described in greater detail below, and differently from previous embodiments of the instant invention, a bearing assembly transfers most of the load of the carrousel file support assembly 46 to the centrally disposed upright member 44 of the base assembly 42. The upper end 48 of the carrousel file support assembly 46 is preferably concealed for aesthetic appearance by a top 50. The top 50 also provides additional useable work surface in the office environment.

Referring to FIGS. 3–7, the base assembly 42 of the file cabinet assembly 40 preferably includes a base 52 which may be formed from steel or aluminum plate, and preferably from 10 or 12 gauge steel, and most preferably 11gauge plate steel. The shape of the base 52 is not believed to be critical, although it is preferred it be circular and of sufficient diameter so as to equally distribute the weight over the defined area, as well as provide a toe-kick space beneath the carrousel file support assembly 46. To help achieve this goal, the bottom surface of the base 52 is fitted with a plurality of radially arranged ribs 54, also preferably formed from metal stock and welded to the surface of the base 52. The ribs 54 radiate from and are disposed about a center hole 56 formed in the base 52 and which receives the lower end 58 of the center post 44. The lower end 58 of the center post 44 is welded to the base 52, as well as the end of the ribs 54 proximate the center hole 56 to provide a secure and rigid support for the center post 44 extending from the base 52. See FIG. 7. In order to reduce the surface area of the ribs 54 contacting the floor at any one time, and to assist in leveling the file cabinet assembly 40, adjustable feet or glides 60 are preferably welded to the ribs 54 and base 52. The adjustable feet 60 also help define the toe-kick for the file cabinet assembly 40, as well as provide a reduced friction surface for sliding the file cabinet assembly 40 to the desired position.

Figure 4:
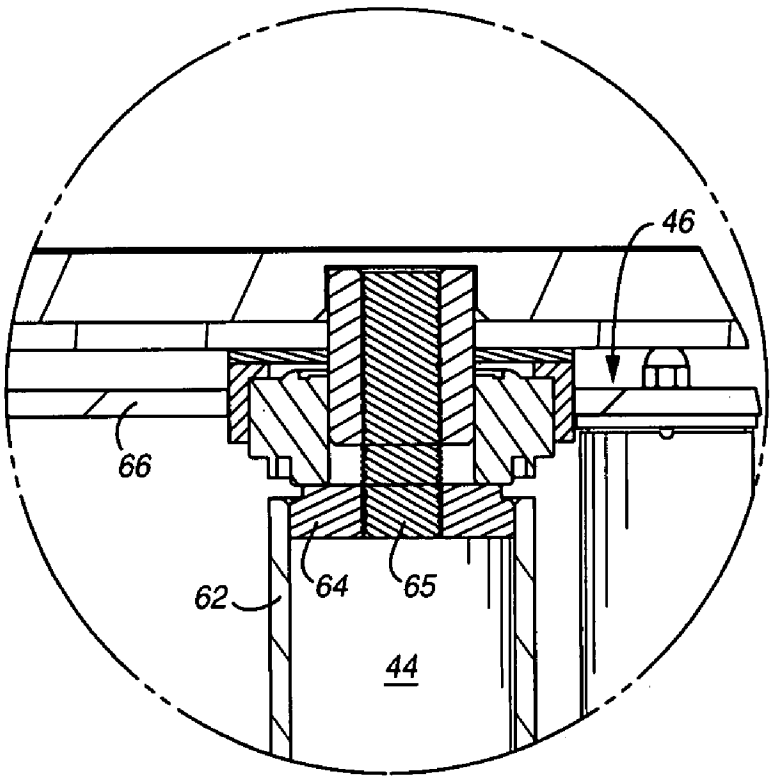
FIG. 4 is an enlarged view of the section shown in circle 4 in FIG. 3.
Figure 7:
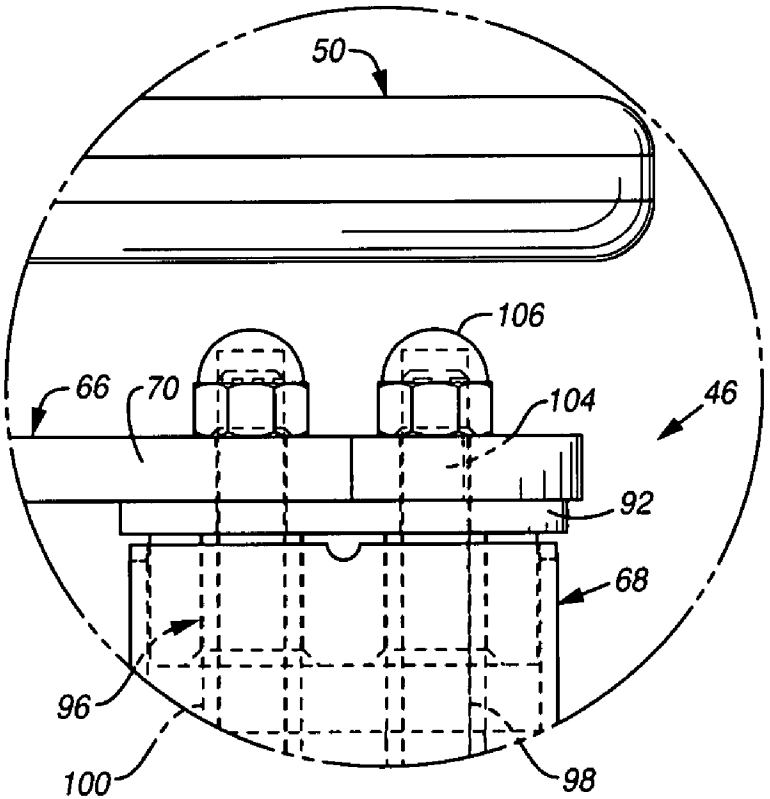
FIG. 7 is an enlarged fragmentary view of an upper portion of the pivot arm assembly shown in FIG. 1.
Figure 6:
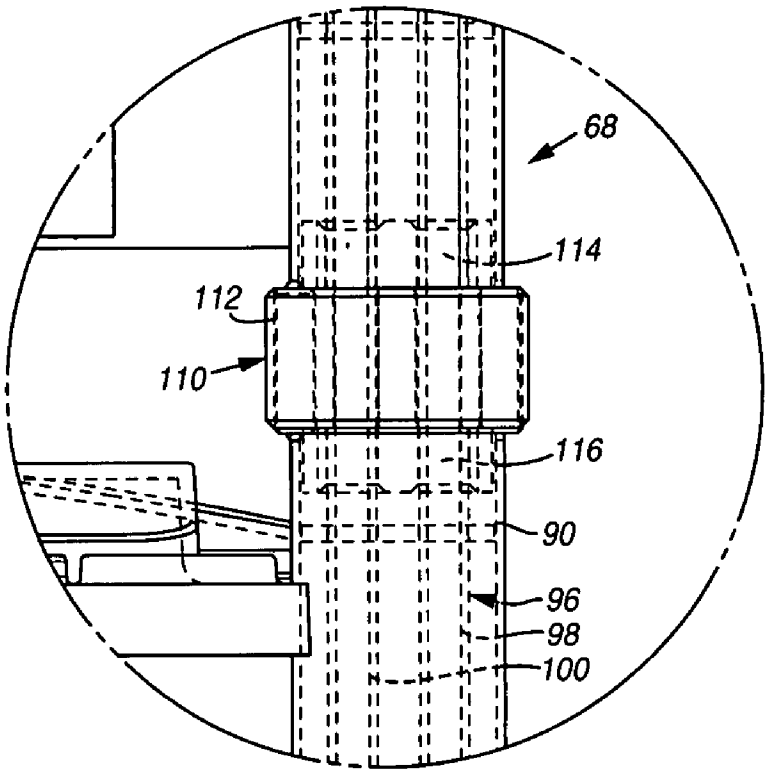
FIG. 6 is an enlarged fragmentary view of the pivot arm assembly shown in FIG. 1.
Figure 10:
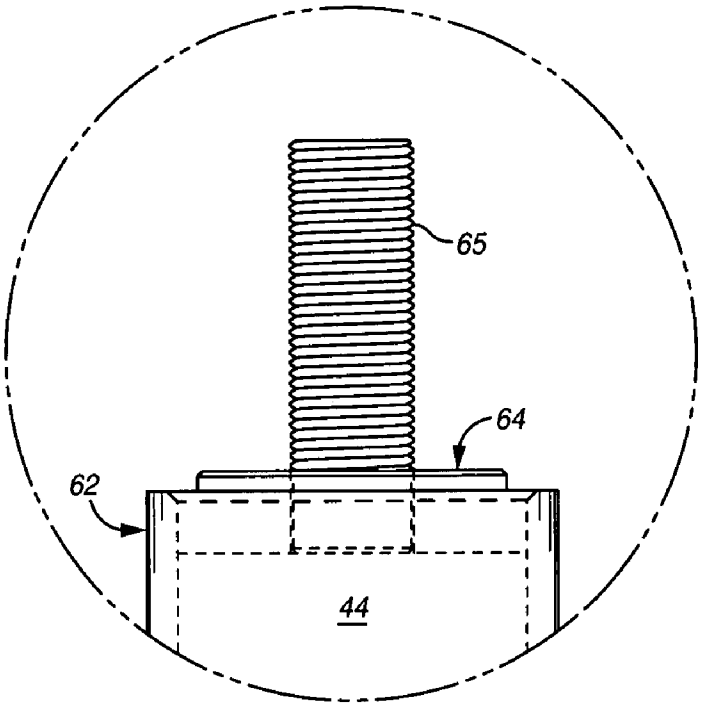
FIG. 10 is an enlarged fragmentary view of an upper portion of the base assembly shown in FIG. 9.
Figure 8:
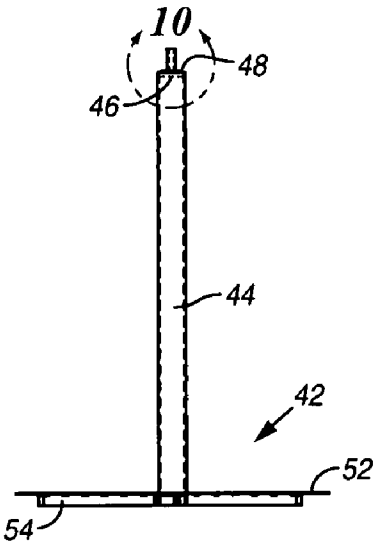
FIG. 8 is an elevation view of one embodiment of a base used in association with the invention.
Figure 9:
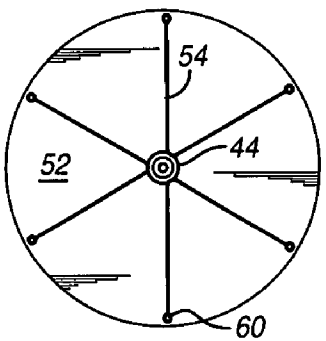
FIG. 9 is a bottom view of the base assembly.
Figure 12A:
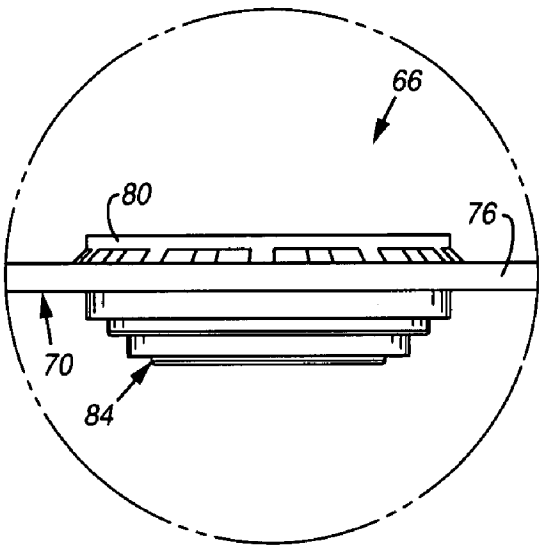
FIG. 12A is an enlarged fragmentary view of the area shown in circle 12A in FIG. 12.
Figure 11:
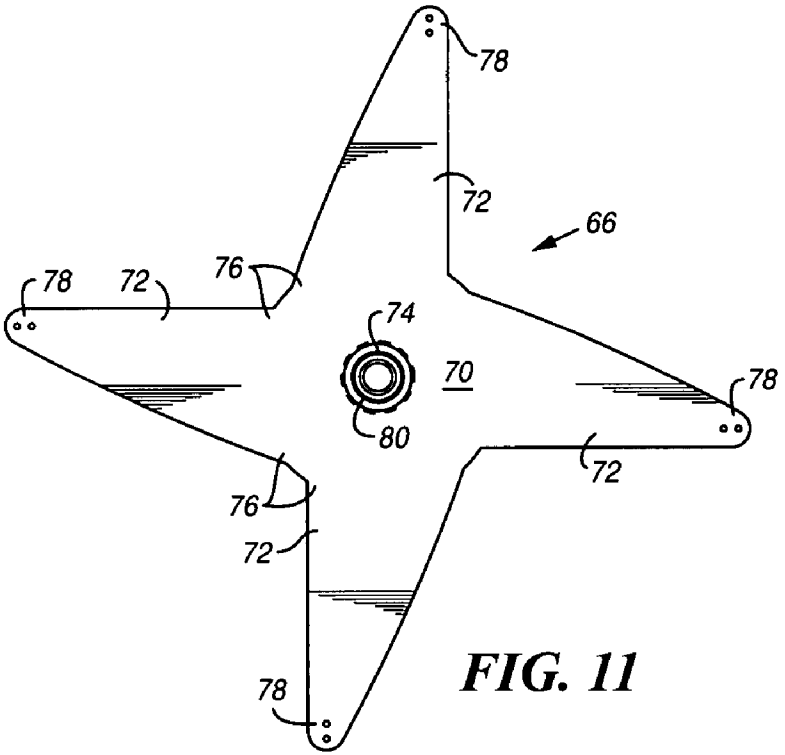
FIG. 11 is a plan view of an upper spider.
Figure 12:
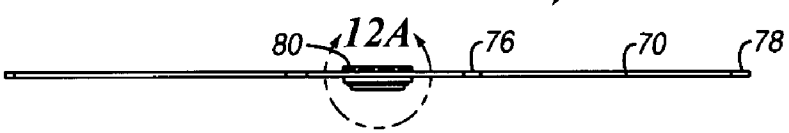
FIG. 12 is an elevation view of the spider shown in FIG. 11.
Figure 14A:
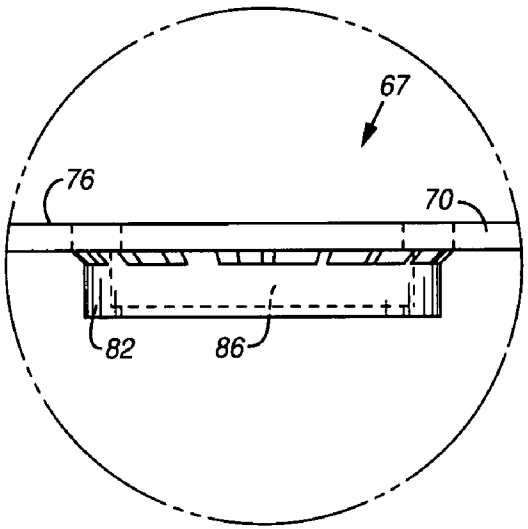
FIG. 14A is an enlarged fragmentary view of the area shown in circle 14A in FIG. 14.
Figure 13:
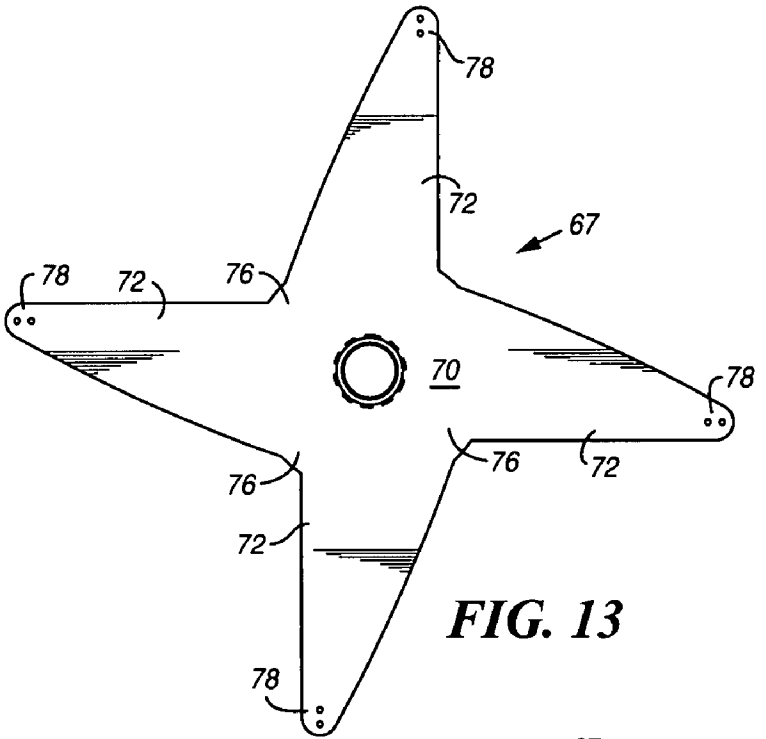
FIG. 13 is a plan view of the lower spider.
Figure 14:
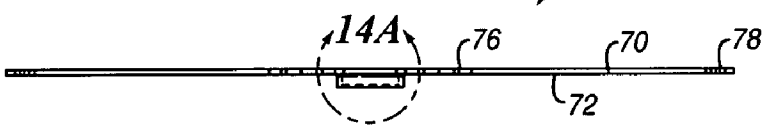
FIG. 14 is an elevation view of the spider shown in FIG. 13.
Figure 15:
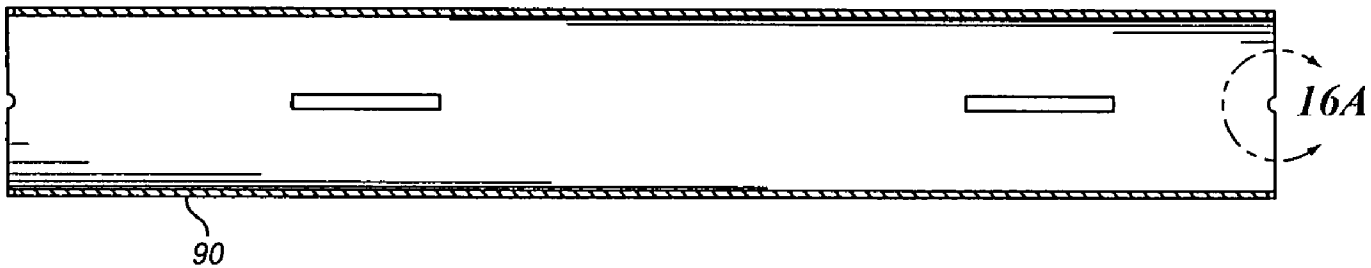
FIG. 15 is a section view of the pivot arm tube.
Figure 16A:
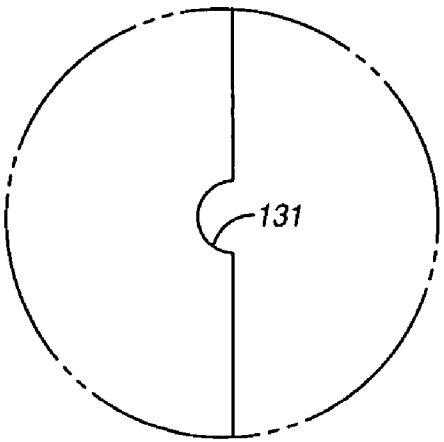
FIG. 16A is a enlarged fragmentary view of circle 16*a* shown in FIG. 15.
Figure 16:
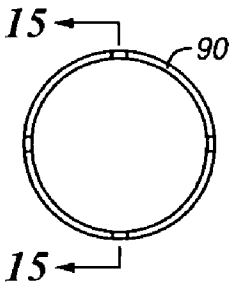
FIG. 16 is an end elevation view of the pivot arm tube.

FIGS. 4 and 6 best illustrate the details of the center post 44. In the preferred embodiment, and as briefly mentioned above, the center post 44 is preferably steel and most preferably a steel tube. As shown in FIG. 6, the upper end 62 of the center post 44 is welded closed by a center tube locator 64 having a concentrically located threaded rod 65 extending vertically therefrom. The carrousel file support assembly 46 described in greater detail below is received over the center post 44 such that an upper end of the carrousel file support assembly 46 rests indirectly on the upper end 62 of the center post 44 and permitted to rotate thereon much like the name of the structure suggests.

The carrousel file support assembly 46 (FIGS. 1, 3, 6, 8, and 9) is received over the center post 44 and is supported at it's upper end 62 so as to rotate freely around the center post 44. The carrousel file support assembly 46 includes an upper and a lower spider assemblies 66,67, respectively, spaced apart from each other vertically, and interconnected at their peripheral edges by a plurality of pivot arm assemblies generally identified by numeral 68. The upper and lower spider assemblies 66, 67, respectively, each include a spider 70 which are substantially identical to each other. See FIGS. 11–14. In a preferred embodiment, each spider 70 includes four radially extending crescent-shaped members 72 symmetrically arranged around a concentric hole 74. The portions of the members 72 proximate the hole 74 are substantially wider at the base 76, and taper in an arcuate fashion to the outer peripheral tips 78. Additionally, each spider 70 receives a ring 80, 82, respectively, rigidly fastened to the inside diameter of each hole 74, preferably held by welds. The ring 80 in the upper spider 70 preferably is configured to receive a tapered roller bearing 84 (FIG. 6) which is press-fit therein. One race of the tapered roller bearing 84 then rests on the upper end 62 of the center post 44. The lower spider 70 is also fitted with a ring or collar 82 which is configured to retain a bushing 86, preferably made from nylon or other low friction material. The inside diameter of the lower ring 82, when fitted with the bushing 86 is just slightly larger than the outside diameter of the center post 44 such than when the carrousel file support assembly 46 is rotated around the roller bearing 84, the lower spider 70 is journaled by the center post 44 which provides stability.

Each of the pivot arm assemblies 68 in their simplest form include a pivot tube 90 of predetermined length and closed at each end by end caps 92, 94, respectively. Disposed within each pivot tube 90 and extending down it's length is a pivot stop weldment 96. Each weldment 96 is received by recesses 97 formed in the inside ends of each end cap 92, 94. Each weldment 96 preferably includes at least two parallel spaced-apart tube members 98, 100, maintained in spaced relationship by at least one, and preferably two semi-circular disks generally identified by numeral 102, the diameter of which permits them to be received inside each pivot tube 90. The tube members 98, 100 are maintained in a fixed position within the pivot tubes 90 by the ends captured in the cylindrical recesses 97 in the end caps 92,94, and from each other and the inner side walls of each pivot tube 90 by the semi-circular disks 102. Threaded rods 104 of predetermined length pass through each of the weldment tube members 98, 100, as well as the holes in each of the end caps 92, 94, and through respective holes at the distal tips 78 of spider members 72. There, fasteners such as cap nuts 106 are used to interconnect the lower spider assembly 67, the pivot arm assemblies 68, and the upper spider assembly 66. In this fashion, the pivot tube 90 is permitted to rotate about the fixed end caps 92, 94, which act as bearing members.

Figure 20:
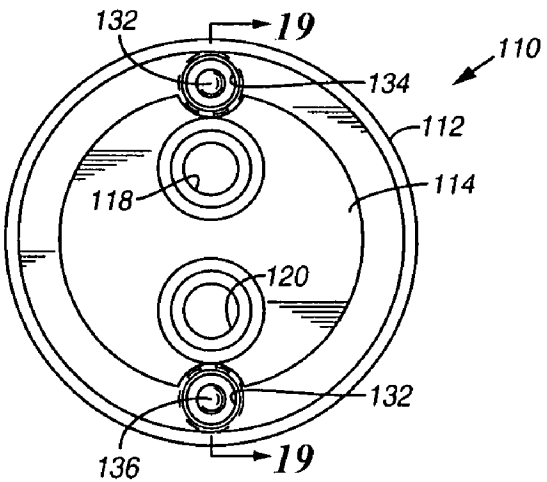
FIG. 20 is an end elevation view of the connector cap shown in FIG. 19.
Figure 17:
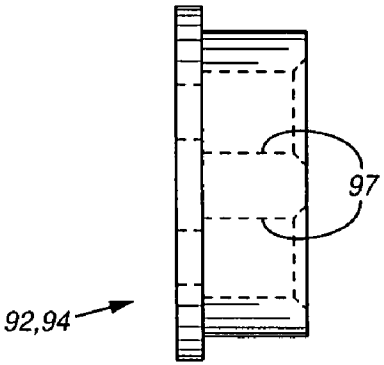
FIG. 17 is a side elevation view of a pivot arm cap.
Figure 19:
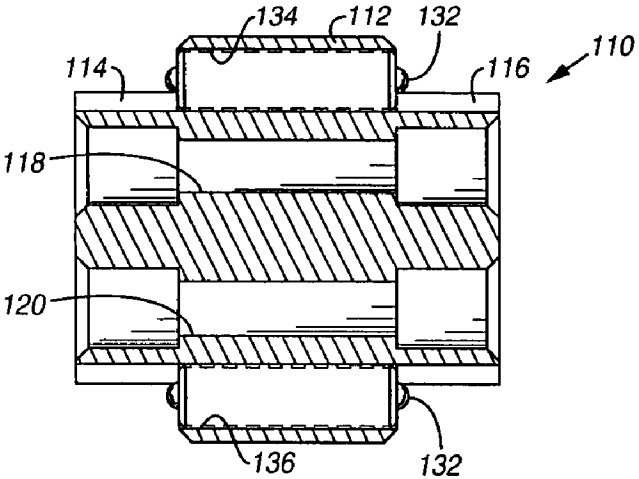
FIG. 19 is a section view of a connecting cap.
Figure 22:
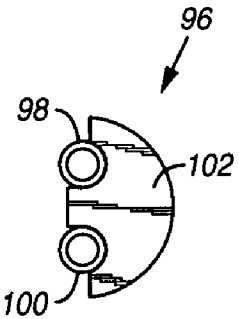
FIG. 22 is an end view of the weldment shown in FIG. 21.
Figure 21:
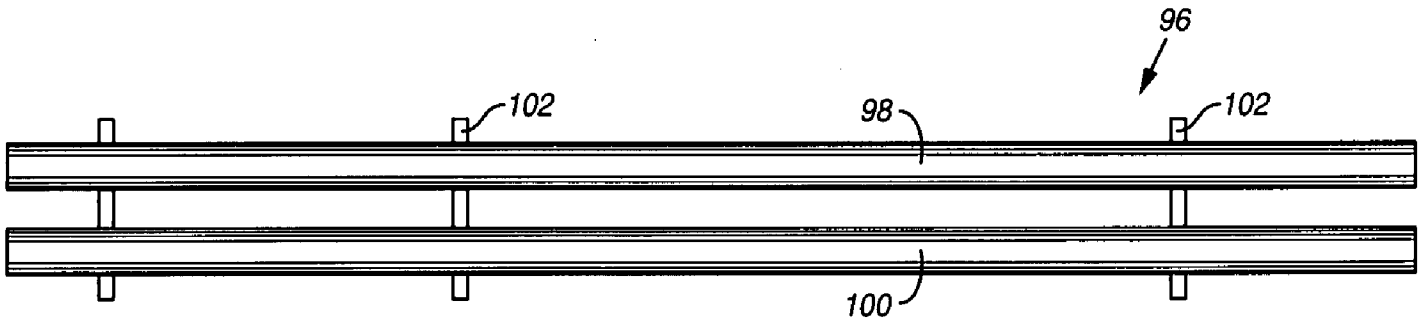
FIG. 21 is a plan view of a weldment.
Figure 23:
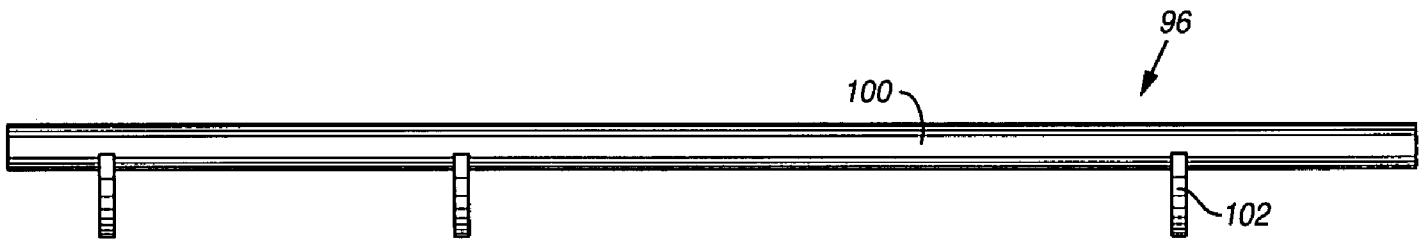
FIG. 23 is an elevation view of the weldment shown in FIG. 21.

The pivot arm assembly 68 generally described is that for a single tier file cabinet assembly. For multiple tier designs such as that shown in FIGS. 1–3, a plurality of pivot tubes 90 are stacked one a top the other. To interconnect vertically adjacent pivot tubes 90, a connector cap 110 may be used. See FIGS. 19 and 20. Each connector cap 110 includes a central body 112 having oppositely extending nipples 114, 116, each of which is configured to be received in an end of a pivot tube 90. Moreover, each connector cap 110 includes two parallel passages 118, 120 dimensioned to receive the respective ends of the weldments 96 and rods 104 passing within each pivot tube 90. In the case of a multi-tier file cabinet assembly such as 40, threaded rods 104 pass the entire length of each stacked set of pivot tubes 90.

Figure 27:
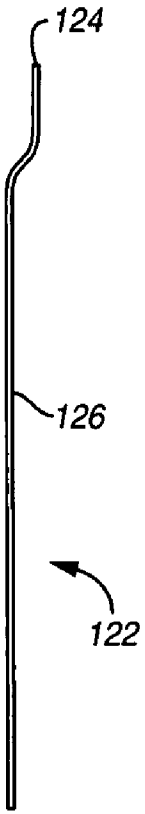
FIG. 27 is an end elevation view of the pivot arm shown in FIG. 26.
Figure 26:
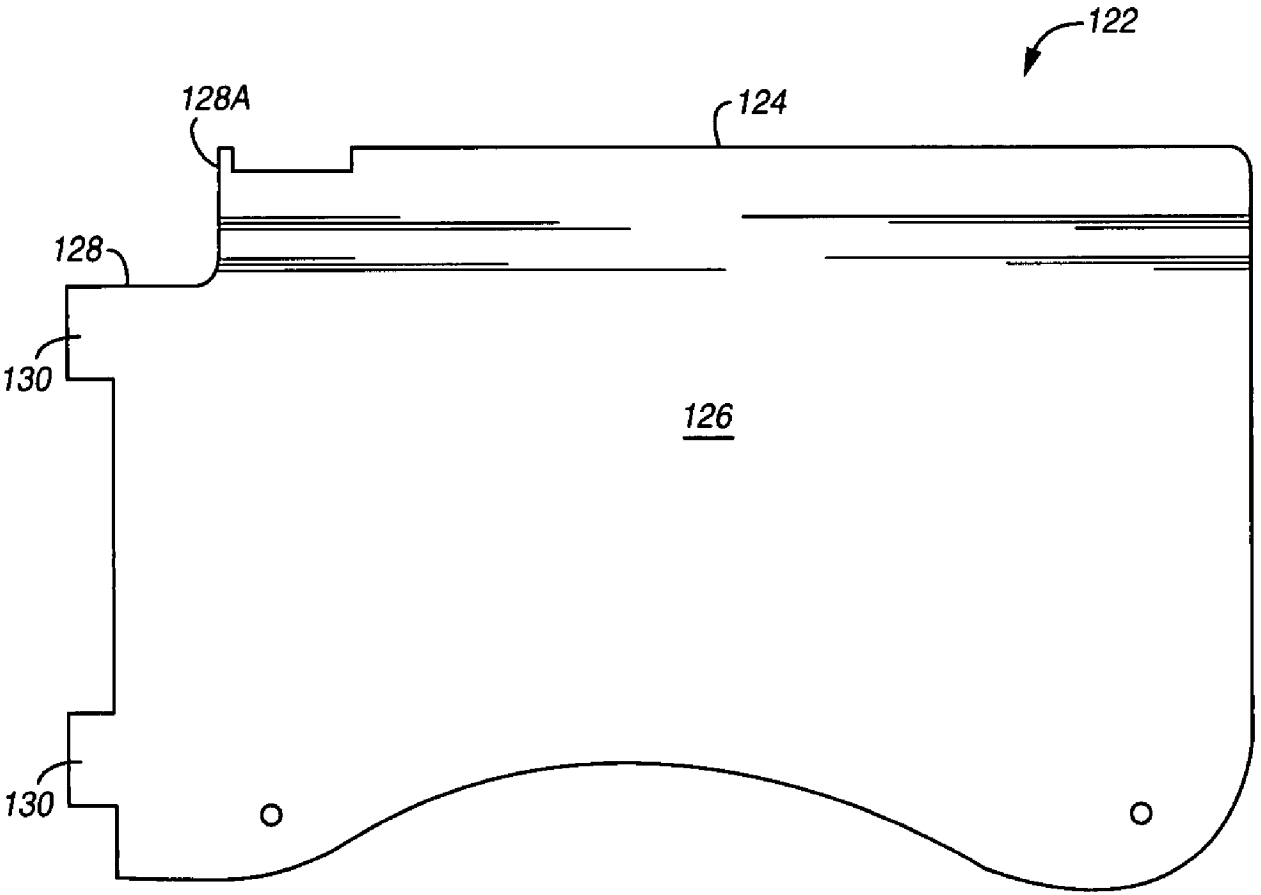
FIG. 26 is a side elevation view of one embodiment of a pivot arm.
Figure 28:
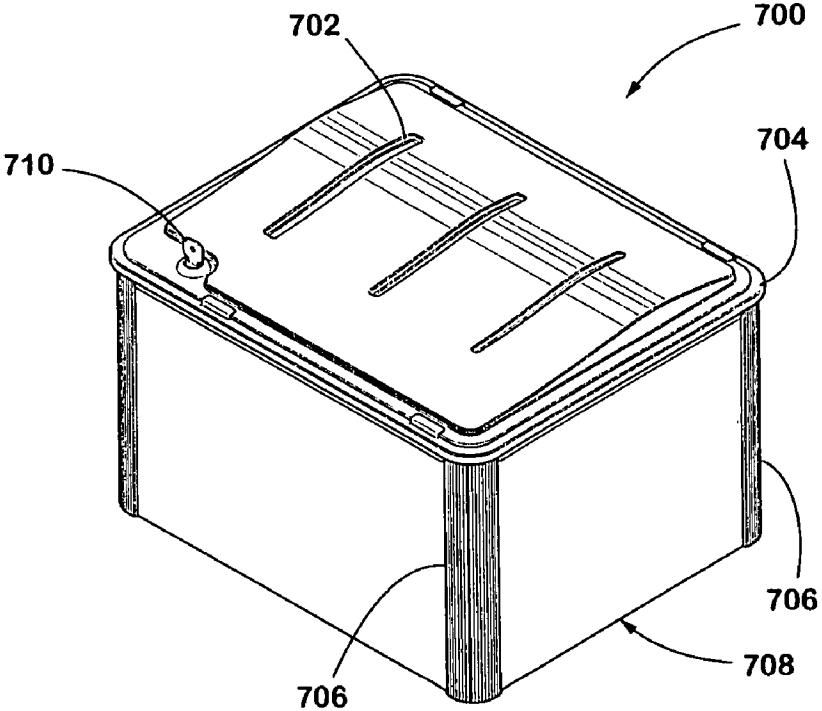
FIG. 28 is an oblique view of one embodiment of a file container contemplated to be used in conjunction with the instant invention.

Each pivot arm assembly 68 further includes a pivot arm 122 which extends radially from each pivot tube 90. In the preferred embodiment, each pivot arm 122 is formed from a stamped sheet of steel or other suitable strength material providing a rigid, generally planar body. See FIGS. 26 and 27. The upper edge 124 of each pivot arm 122 is curved or bent to be laterally offset, yet generally parallel to that of the primary body 126, to provide an edge for hanging containers such as these described in greater detail below. The upper edge 124, proximate the pivot tube 90 also includes a punched or cut-out portion 128 to provide a shoulder 128*a* to retain the containers, described herein, from sliding off each pivot arm 122. With respect to the edge of the pivot arm 122 in contact with the pivot tube 90, tabs 130 are provided which are received in slots formed in the side of each pivot tube 90. Each pivot arm 122 is preferably welded or otherwise permanently attached to each pivot tube 90 to withstand a substantial moment on the pivot arm 122. The tabs 130 extending into the interior of the pivot tube 90 interfere with the weldment tube members 98, 100 and disk 102 in a manner to limit the rotational extent of each pivot arm 122. Mechanisms may also be included in each pivot arm assembly 68 to temporarily hold the rotational position of the pivot arm 122.

All of these structures are intended to provide rotary access to all of the containers in the file cabinet assembly 40 without orienting or positioning the file cabinet assembly 40 in a particular manner. It is also desired to place sufficient restrictions on each pivot arm 122 such that centrifugal forces do not cause the pivot arms 122 to extend or rotate about the axis of the pivot tubes 90 when the carrousel file support assembly 46 is rotated. However, it is also preferred the operator can easily swing the pivot arms 122 out from the carrousel file support assembly 46 when desired to remove or replace a particular container.

Figure 18:
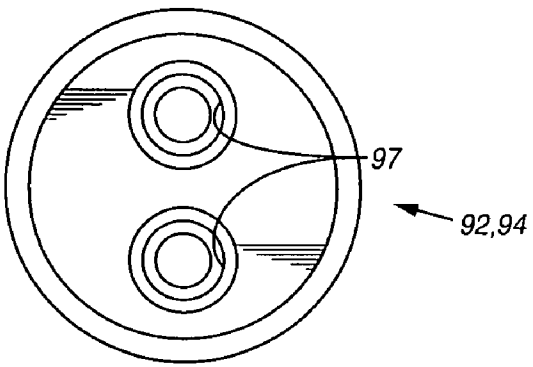
FIG. 18 is an end elevation view of the pivot arm cap.

The general structure described above permits each pivot tube 90 to rotate a predetermined angle about its vertical axis. The end caps 92, 94 at the top and bottom of a pivot arm assembly 68, as well as any intermediate connector caps 110, are maintained stationary relative to each pivot tube 90 by the enclosed weldments 96 and threaded rods 104. The tabs 130 of each pivot arm 122 extending into each pivot tube 90 interfere with the enclosed weldments 96 to limit the arcuate travel. In addition, the ends of each pivot tube 90 contain notches 131 (FIG. 18) at predetermined angular intervals to engage a biased detent or peg 132 disposed within passages 134, 136 immediately outboard of passages 118, 120 in the connector caps 110. See FIG. 19. Using such a mechanical mechanism, each pivot tube 90 can be held temporarily at a predetermined position such as fully closed, partially extended, and fully extended position. Such detent mechanisms also serve to keep the pivot arms 122 in the retracted position during rotation of the carrousel file support assembly 46.

Figure 25:
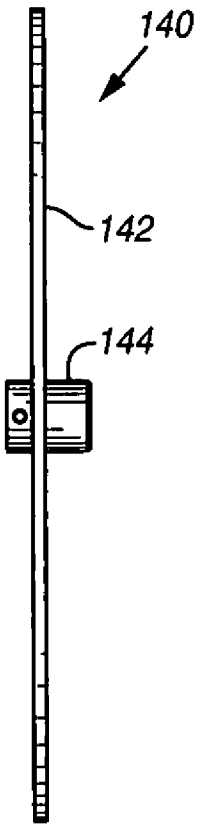
FIG. 25 is an elevation view of the top attachment shown in FIG. 24.
Figure 24:
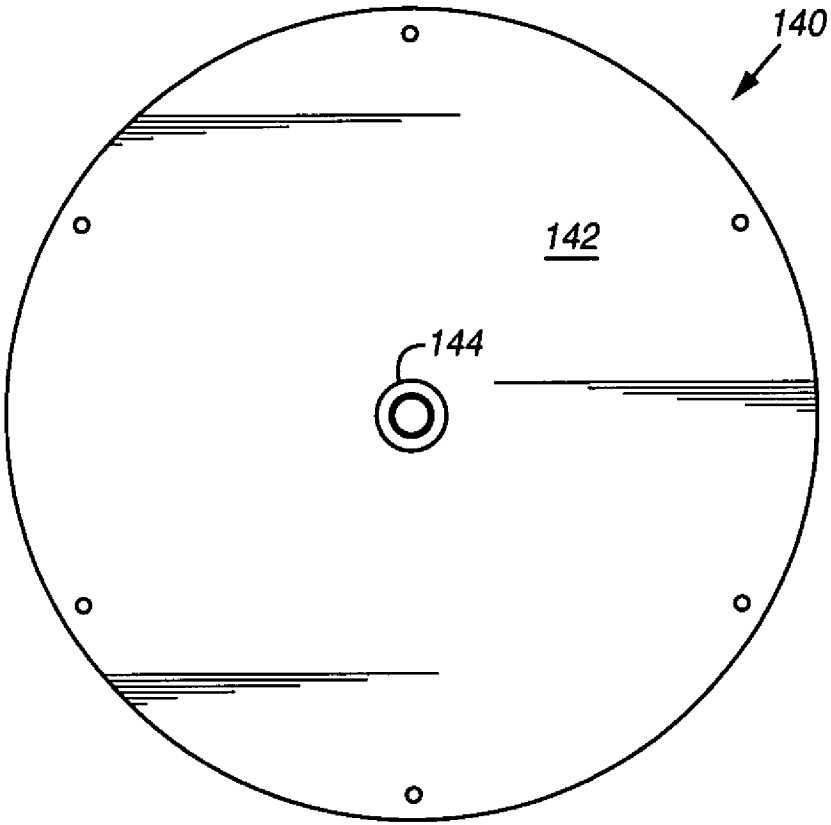
FIG. 24 is a plan view of a top attachment.

FIGS. 24 and 25 schematically illustrate the top attachment member 140 which serves to center and retain the carrousel file support assembly 46 on the base assembly 42, as well as provide an attachment for the top 50. Member 140 includes a plate 142 having a centered pilot tube member 144 passing through the center of the plate 142. Preferably both are formed from steel and welded together. The plate 142 is of sufficient diameter so as to provide ample support to the top 50 which is attached by screws passing through peripheral holes. The pilot tube member 144 preferably has an outside diameter slightly less than the inside diameter of the roller bearing 84, and an inside diameter which is threaded to mate with the threads of rod 65 extending from the locator 64 at the upper end 62 of the center post 44. See FIG. 6. The pilot tube member 144 includes a transverse threaded passage for a set screw to hold the pilot tube member 144 in position once tightened to the predetermined point of rod 65. A self lubricating washer may be disposed between the lower surface of plate 142 and the upper ring 80 of the upper spider assembly 66. The washer would help adjust the amount of rotational friction on the carrousel file support assembly 46, depending in substantial part on the amount of pressure exerted upon the roller bearing 84 by the top attachment member 140.

Figure 29:
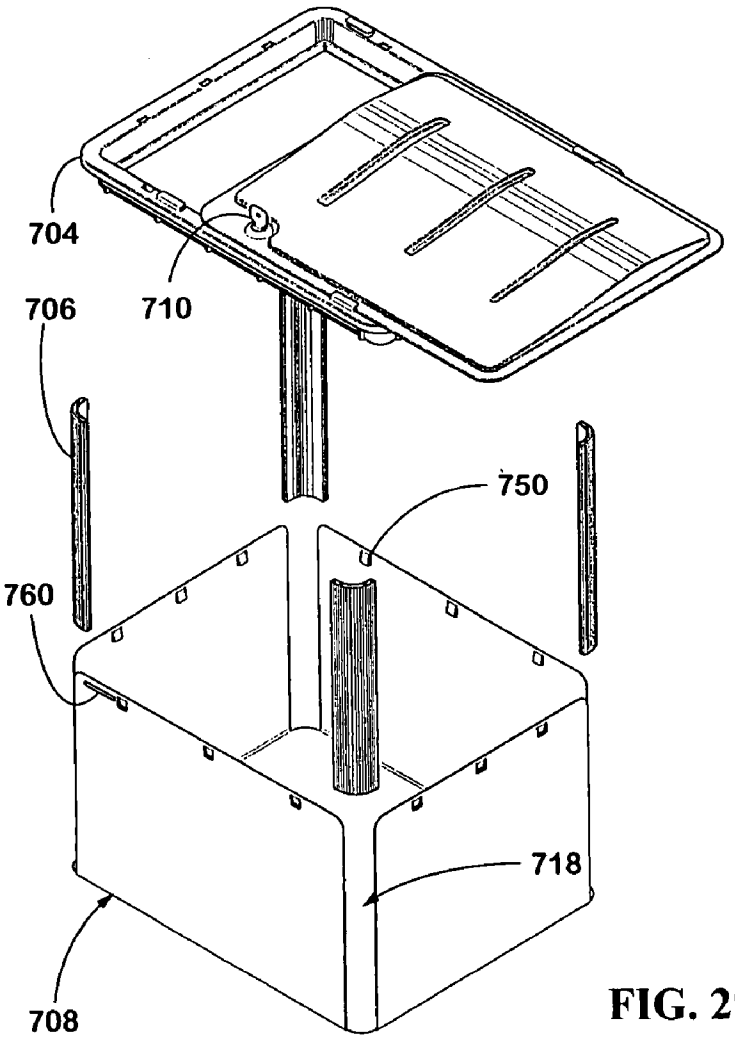
FIG. 29 is an exploded view of the file container shown in FIG. 28.

One embodiment of a container assembly 700 adapted for use in conjunction with the instant invention is illustrated in FIGS. 28–40. Each container 700 includes a top 702, a frame 704 for receiving the top 702, a plurality of corner members 706 and a box assembly 708. In addition, a lock assembly 710 is available to lock the top in a closed position. As best illustrated in FIG. 29, the box assembly 708 is preferably formed from flat metal stock such as aluminum, stamped in a manner to provide a central bottom panel 712 integrally connected to a plurality of side panels 714 along hinge lines 716. The plurality of side panels 714 are folded along each of the hinge lines 716 such that the side panels 714 are oriented generally perpendicularly to the bottom panel 712. When in the folded and upright position relative to the bottom panel 712, a gap 718 remains between adjacent side panels 714 at each corner of the box assembly 708.

Figure 32:
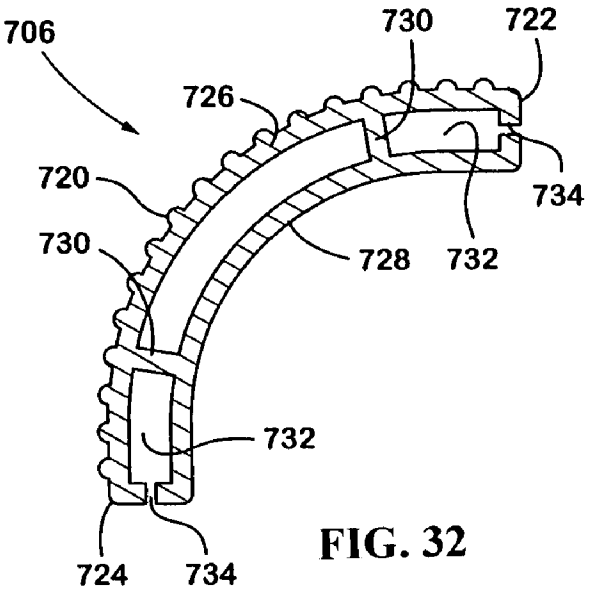
FIG. 32 is a section view of the corner member taken along line 32—32 shown in FIG. 31.
Figure 31:
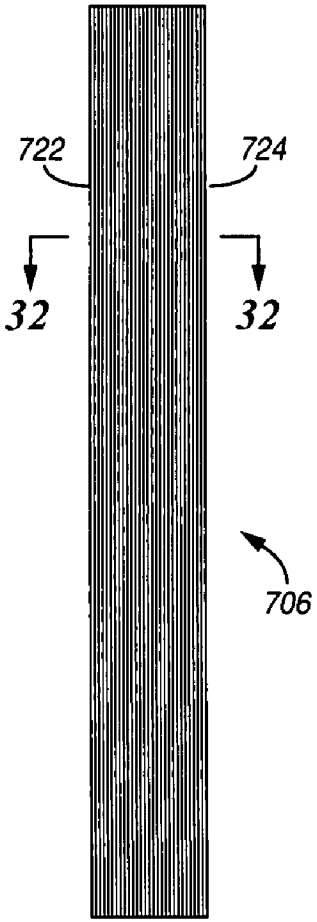
FIG. 31 is an elevation view of a corner member.

Interconnecting adjacent side panels 714 and filing each of the gaps 718 of the box assembly are the corner members 706. In a preferred embodiment each corner member 706, shown in FIGS. 31 and 32, is extruded from a polymeric material having a relatively high durometer hardness such that each corner member 706 is substantially rigid. The exterior surface 720 is preferably ribbed although any one of a number of different textures may be formed. In addition, any one of a number of configurations may be adopted ranging from right angle transverse cross sections to very rounded cross sections, so long as the edges 722 and 724 of each corner member are able to interconnect the adjacent side panels 714. In the embodiment shown in FIG. 29, a radiused configuration is shown having inner and outer walls 726 and 728, respectively, interconnected by two spaced apart bulkheads 730. The bulkheads 730 are spaced inwardly from edges 722 and 724. A c-shaped channel 732 is formed by a longitudinal slot 734 extending the length of each edge 722, 724 which is configured to receive an edge of one of the adjacent side panels 714—the edge of each side panel extending no further into each channel 732 than to bulkheads 730. Although polymeric materials are disclosed for forming each of the corner components, other materials may be used as well, including aluminum and other extrudable metals.

Figure 35:
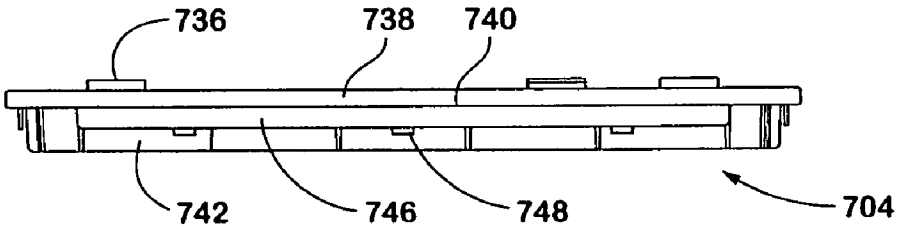
FIG. 35 is a side elevation view of a file container frame.
Figure 36:
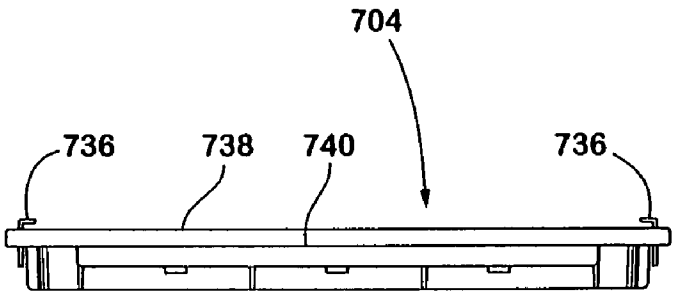
FIG. 36 is an end elevation view of the file container frame shown in FIG. 35.
Figure 37:
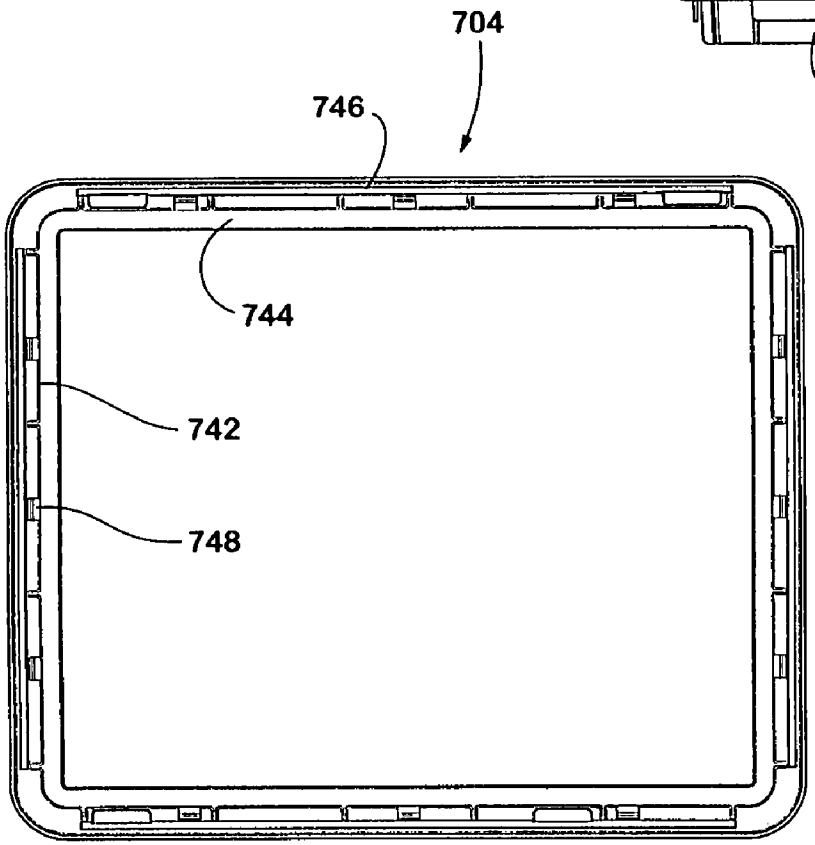
FIG. 37 is a bottom plan view of a file container frame shown in FIGS. 35 and 36.
Figure 39:
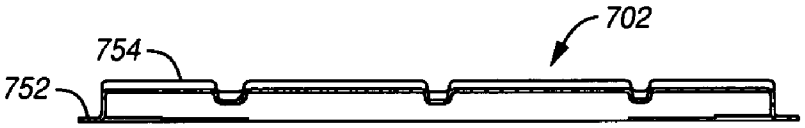
FIG. 39 is a longitudinal cross-section of the file container lid taken along line IL—IL shown in FIG. 38.
Figure 38:
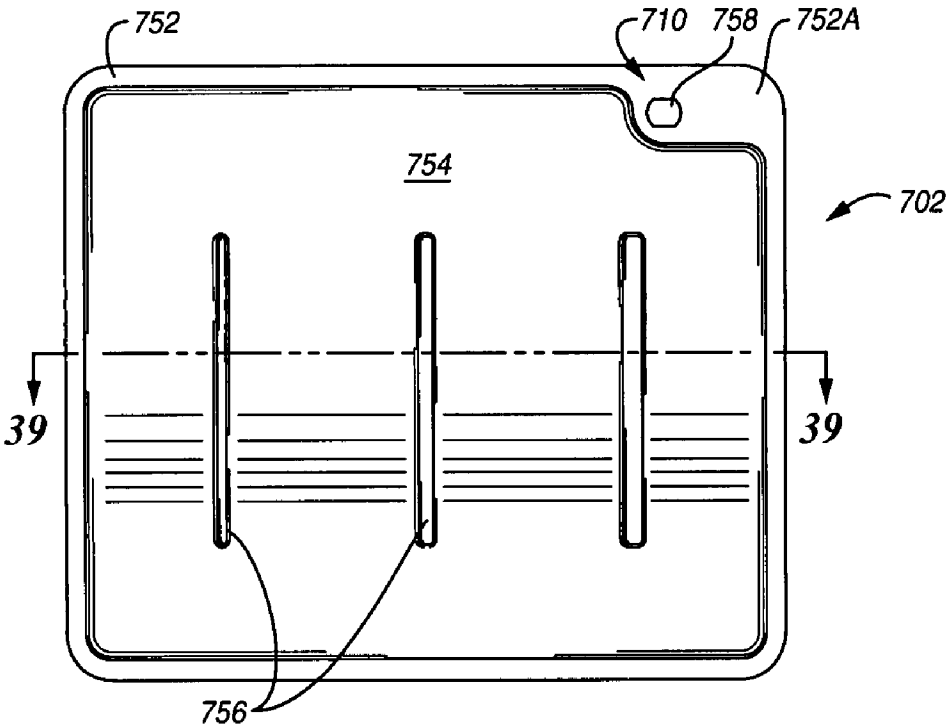
FIG. 38 is a plan view of the file container lid.
Figure 40:
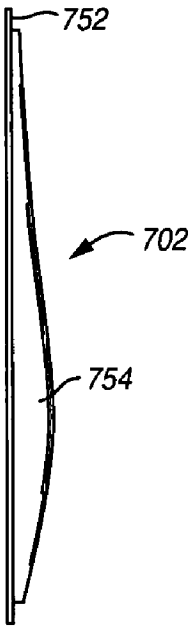
FIG. 40 is an end elevation view of the file container lid.

FIGS. 35 through 37 provide a better illustration of the frame 704 which is intended to be attached to the upper edges of the side panels 714 to provide a substantially rigid container. In the embodiment shown, frame 704 is generally rectangular, although other forms may be used, and includes a plurality of spaced apart flanges 736 formed on the upper surface 738 of the rim 740. The flanges 736 are arranged to provide channels around a substantial portion of the rim 740. Extending inwardly from an inner wall 742 towards a center of the frame 706 is a race 744 having an upwardly turned inner edge. The race 744 is positioned below the upper surface 738 of the rim 740 to provide a surface for supporting hanging folders such as those available under the PENDAFLEX™ brand name. Below the race 744, and spaced outboard from inner wall 742 is an outer wall 746, the gap between the inner and outer walls 742, 746 is intended to receive the upper edge of each of the side panels 714. To retain the rim 740 of the frame 706 on the upper edge of the side panels 714, a plurality of detents or bosses 748 are defined on the inner and/or outer walls, a plurality of which are intended to engage in snap-fit arrangement a like plurality of holes 750 formed in each of the side panels 714. The holes 750 are preferably formed during the stamping or forming process of the box assembly 708. A side view of one such hole 750 in one of the side panels 714 is illustrated in a fragmentary side view in FIG. 30. The frame 704 is received on the top of the plurality of side panels 714 such that the upper edge of the side panels, nor the detents 748, is not exposed, in effect creating a substantially permanent attachment of the frame to the upper edge of the box assembly, and any sharp edges of the box assembly are concealed behind the inner and outer walls 742, 746, respectively. It is contemplated that plastic injection molding is the best mode for manufacturing the frame although is seems possible that other methods and materials may also be used, including stereo lithography, machining, milling, and a form of stacked or layering construction of plastics, metal, or wood.

The top, shown in FIGS. 29 and 38 through 40, is also preferably formed using plastic injection molding methods. In the embodiment shown, the top 702 includes an perimeter flange 752 substantially surrounding a generally raised or arched central portion 754. To provide structural rigidity to the relatively large expansive raised central portion, grooves 756 are formed in the material at an angle to the long axis of the top. Together with the contours formed at the opposite ends of the raised central portion, the central portion 754 becomes substantially rigid, enabling the top 702 to be received in sliding engagement with the frame 704, the perimeter flanges 752 constrained by the flanges 736 on the rim 740.

Figure 30:
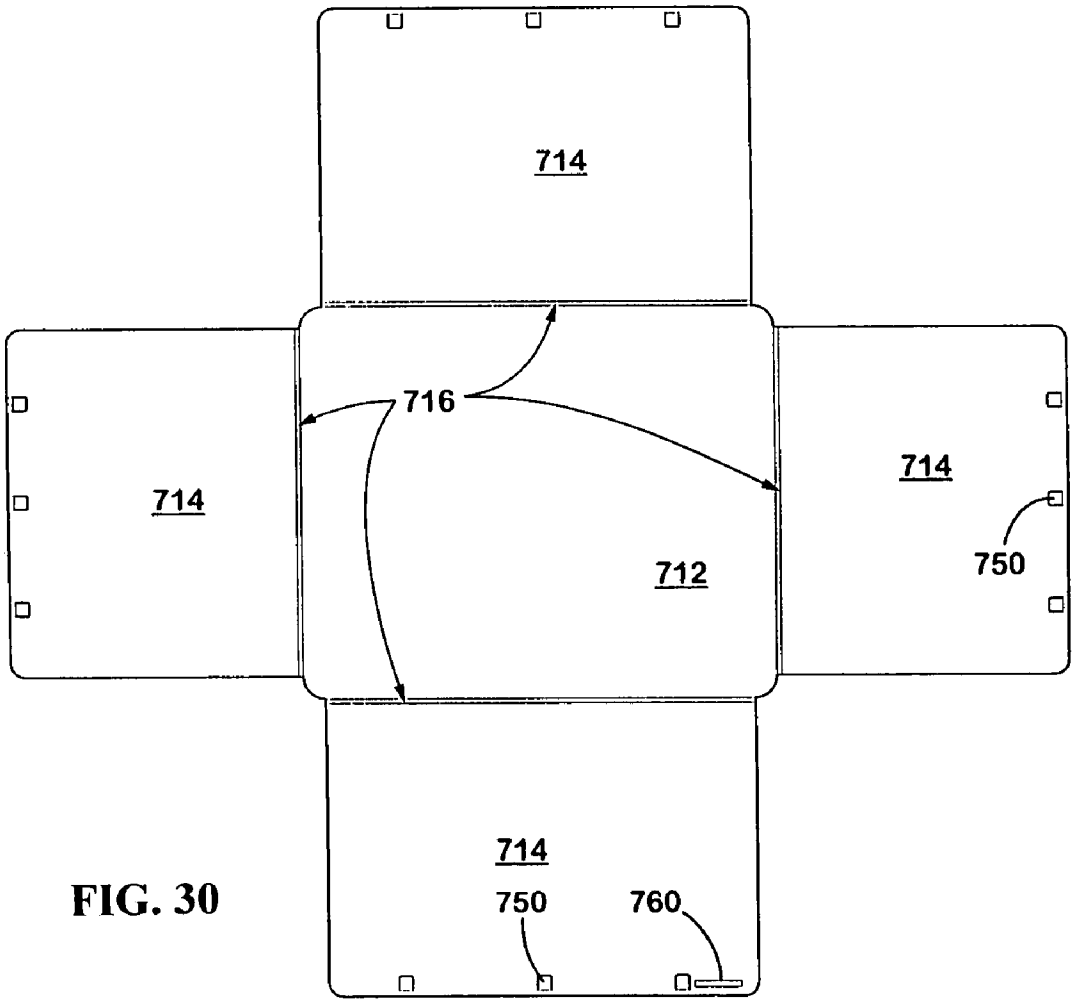
FIG. 30 is a plan view of the file container bottom and wall panels shown in a flattened configuration.
Figure 34:
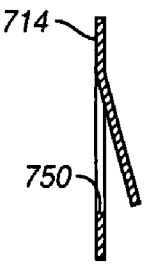
FIG. 34 is a detailed fragmentary side view of a portion of a wall panel shown in FIG. 33.
Figure 33:
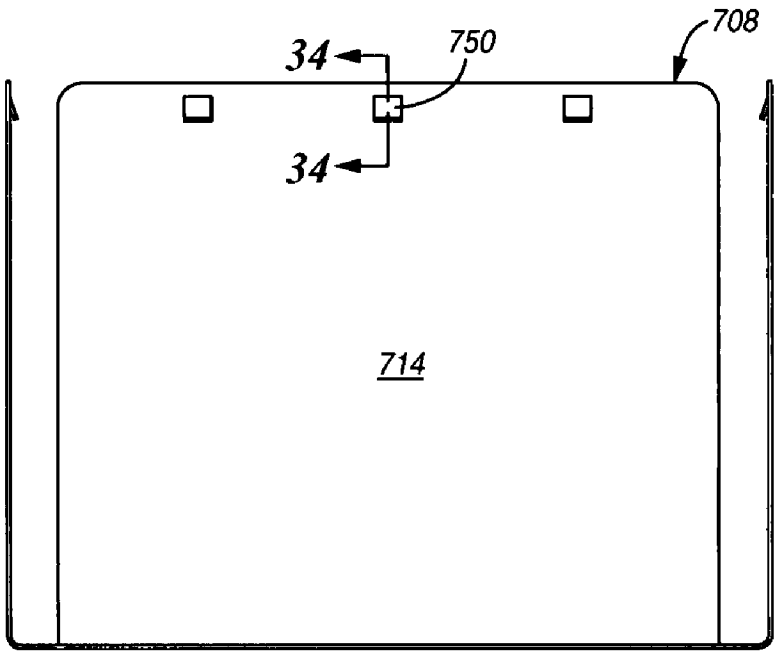
FIG. 33 is an elevation view of the wall panels.

To provide a relatively secure container, it is contemplated a lock assembly 710 may be mounted in portion of the top 702 proximate one of the corners. To accommodate a lock such as 710, one of the perimeter flanges 752*a* is extended and provided with a hole 758 for receiving the lock assembly 710. In a conventional manner, the lock 710 is retained by a nut on the underside of the flange 752*a* and equipped with a bar which rotates into engagement with a slot formed in the inner wall of the frame, preventing the top from sliding open. To provide a more secure arrangement, the bar of the lock 710 may extend through a slot 760 defined in the upper edge of one of the side panels such is illustrated in FIGS. 29 and 30.

As mentioned briefly above, it is the intention of this invention to suspend one or more of the container assemblies on the pivot arms 82 such that the containers may swing between a stored and extended position on the central carrousel assembly. To achieve this goal, the frame 704 of each container assembly 700 also includes a channel 760 defined between the inner and outer walls 742, 756, respectively, capable of receiving the upper edge 84 of any given pivot arm 82. Moreover, it is contemplated that channel 760 have a vertical profile which mirrors the vertical profile of the upper edge 84 such that a portion of the frame 704 is received within the cut-out and precludes the container 700 from sliding along the arm's upper edge 84. It is also contemplated that the cut-out 88 also makes accommodation for the bar of any lock assembly 710 when stored in the locked position.

In operation, the user simply hangs the desired containers briefly mentioned above on the pivot arms 122 extending from the pivot tub 90. The pivot tubes 90 are mounted such they are able to rotate between a stowed position where the pivot arms 122 are oriented toward the upright member 44, and an extended position such that containers can be removed from, or replaced upon, the pivot arms 122. To further enhance access to the containers, the carrousel file support assembly 46 is free to rotate 360 degrees in either direction about the center post 44. In this embodiment, with or without file containers, without fear of upsetting the file cabinet assembly 40. Moreover, the files can be fully accessed around the perimeter of the file cabinet assembly 40. If in a corner or against a wall, the rotating carrousel file support assembly 46 permits the user easy access to the desired file.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention as interpreted according to the principles of patent law, including the doctrine of equivalents.

We claim:

1. A file cabinet assembly, comprising in combination:
- a base plate;
- a center post defining an upright member, having a first end extending through and secured to said base plate, and an upper end terminating in a threaded rod;
- a bearing support concentrically received over said threaded rod and resting on an upper end of said center post; and
- a carrousel file support assembly suspended from an upper end of said upright member such that said carrousel file support assembly rotates freely around said upright member.

2. The file cabinet assembly as defined in claim 1, wherein said carrousel file support assembly includes:
- an upper spider assembly and a lower spider assembly spaced apart from each other; and
- a plurality of pivot arm assemblies interconnecting said upper spider assembly with said lower spider assembly.

3. The file cabinet assembly as defined in claim 2, wherein said upper spider assembly includes:
- a spider having a central opening and a plurality of radially extending arms;
- an upper ring fixed in said central opening; and
- a tapered bearing concentrically received within said upper ring, and configured to concentrically receive said threaded rod terminating said upper end of said center post.

4. The file cabinet assembly as defined in claim 2, wherein said lower spider assembly includes:
- a spider having a central opening and a plurality of radially extending arms;
- a lower ring fixed within said central opening of said spider, said lower ring having an inner diameter greater than a diameter of said center post; and
- a bushing member disposed between said lower ring and said center post.

5. The file cabinet assembly as defined in claim 2, wherein each of said plurality of pivot arm assemblies, include:
- a pivot tube having opposite ends;
- an end cap disposed in at least one of said opposite ends;
- a pivot stop assembly disposed within said pivot tube and extending between said opposite ends; and
- a first and second connector extending through said end cap, said pivot stop assembly, and through said upper and lower spider assembly.

6. The file cabinet assembly as defined in claim 5, wherein each of said plurality of pivot arm assemblies further includes a mechanism for preventing said pivot tube from rotating freely between a first position and a second position.

7. The file cabinet assembly as defined in claim 2, wherein each of said plurality of pivot arm assemblies include;
- a pivot tube having a first end and a second end;
- a hanger arm intermediate said first and second end of said pivot tube and extending perpendicular thereto; and
- a bearing cap in said first and second ends of said pivot tube.

8. The file cabinet assembly as defined in claim 2, wherein each of said pivot arm assemblies include at least one weldment assembly extending through said pivot arm assemblies and interconnecting said upper and lower spider assemblies.

9. A carrousel file cabinet, comprising in combination:
- a base;
- an upright extending from said base;
- a carrousel file support assembly suspended from an upper end of said upright and adapted to rotate relative to said base; and
- a plurality of pivot arm assemblies on said carrousel file support assembly, each rotatable between a stowed position and an extended position about an axis substantially parallel to said carrousel file support assembly.

10. The carrousel file cabinet as defined in claim 9, further comprising a pivot arm for detachably receiving a container thereon.

11. The carrousel file cabinet as defined in claim 9, wherein said base includes a hub having at least one radially extending member for providing vertical support for the carrousel file cabinet.

12. The carrousel file cabinet as defined in claim 9, wherein said carrousel file support assembly includes:
- a plurality of spiders spaced vertically from each other and
- a bearing member interconnecting at least one of said plurality of spiders to said upper end of said upright to permit said plurality of spiders to rotate relative to said base.

13. The carrousel file cabinet as defined in claim 12, wherein each of said pivot arm assemblies includes:
- a cylindrical member having first and second ends;
- a bearing member disposed in each of said first and second ends, each bearing member interconnected to one of said plurality of spiders;
- a hanger arm extending from said cylindrical member; and
- a member internal said cylindrical member and cooperating with an end of said hanger arm to control a rotation angle of said hanger arm and said cylindrical member between said stowed position and said extended position.

14. The carrousel file cabinet as defined in claim 12, further comprising a plurality of tiers of said carrousel file assembly stacked upon one another and coupled to said base.

15. The carrousel file cabinet as defined in claim 9, wherein each of said pivot arm assemblies includes:
- a pivot tube having a first and a second end;
- a bearing member disposed in said first and second ends of said pivot
- a hanger arm extending from said pivot tube; and
- a member cooperating with said hanger arm to control a rotation angle of each pivot tube between said stowed position and said extended position.

16. A method for manufacturing a carrousel file assembly, comprising the steps of:
- providing a base assembly having an upright member;

sliding a lower spider over and down said upright member;

mounting an upper spider to an upper end of said upright member;

providing a bearing member between said upper spider and said upper end of said upright member such that said upper spider is suspended from said upright member; and interconnecting to said lower spider to said upper spider by a plurality of pivot arm assemblies, each configured to support at least one detachable container and pivot between a first stowed position and a second extended position.

17. A file cabinet assembly, comprising in combination:

a base assembly having an upright; and a carrousel assembly suspended from an upper end of said upright such that said carrousel assembly rotates freely around said upright, said carrousel assembly including an upper spider assembly and a lower spider assembly spaced apart from each other; and a plurality of pivot arm assemblies interconnecting said upper spider assembly with said lower spider assembly, said upper spider assembly including a spider having a central opening and a plurality of radially extending arms; an upper ring having a recessed inner wall fixed in said central opening; and a bearing assembly concentrically disposed within said upper ring and configured to concentrically receive said upper end of said upright.

18. The file cabinet assembly as defined in claim 17, wherein said base assembly includes:

a base plate;

a center post having a first end secured to said base plate, and an upper end terminating in a rod; and a bearing support concentrically received over said rod and resting on said upper end of said center post.

19. The file cabinet assembly as defined in claim 17, wherein each of said plurality of pivot arm assemblies include:

a pivot tube having a first end and a second end;

a hanger arm intermediate said first and second end of said pivot tube and extending there from; and a bearing cap in at least one of said first and second ends of said pivot tube.

20. The file cabinet assembly as defined in claim 19, further including a mechanism for preventing said pivot tube from rotating freely between a first position and a second position.

21. The file cabinet assembly as defined in claim 17, wherein each of said plurality of pivot arm assemblies include at least one weldment assembly interconnecting said upper and lower spider assemblies.

22. A file cabinet, comprising in combination:

a base; and a carrousel file support assembly suspended from an upper end of said base such that said carrousel file support assembly partially surrounds said base and rotates freely with respect to said base, said carrousel file support assembly including an upper spider assembly and a lower spider assembly spaced apart from one another; and a plurality of pivot arm assemblies interconnecting said upper spider assembly to said lower spider assembly, each pivot arm assembly including a pivot tube having opposing ends; an end cap disposed in at least one of said opposing ends; a pivot stop assembly disposed within said pivot tube and extending between said opposing ends; and a first and second connector extending through said end cap, said pivot stop assembly and through said upper and lower spider assembly.

23. A file cabinet assembly, comprising in combination:

a base assembly having an upright; and a carrousel assembly substantially surrounding said upright and suspended from an upper end of said upright in a manner to rotate freely relative to said upright, said carrousel assembly including an upper spider assembly and a lower spider assembly spaced apart from one another; said lower spider assembly including a spider having a central opening for receiving said upright there through;

a lower ring fixed within said central opening and having an inner diameter greater than a diameter of said upright; and a bushing member disposed between said lower ring and said upright.

24. A method for manufacturing the file cabinet assembly as defined in claim 23, comprising the steps of:

providing said base assembly having said upright;

mounting a bearing member to one of said upper end of said upright and said upper spider of said carrousel;

sliding said upright through said central opening in said lower spider; and hanging said upper spider of said carrousel on said upper end of said upright such that said bearing member suspends said carrousel around and envelopes said upright and is adapted to rotate on said bearing member with respect to said upright.

25. A carrousel file cabinet, comprising in combination:

a base;

an upright extending from said base and having an upper end;

a carrousel file support assembly concentrically received over said upright member and suspended from said upper end for rotation around said upright member, said carrousel file support assembly having at least a first spider and a second spider spaced from one another, a bearing member disposed between one of said first and second spiders and said upper end of said upright member; and a plurality of pivot arm assemblies interconnecting said upper spider to said lower spider in spaced relation, each of said pivot arm assemblies adapted to rotate between a stowed position and an extended position about an axis substantially parallel to said upright.

26. The file cabinet as defined in claim 25, wherein each of said pivot arm assemblies further comprises a pivot arm for detachably receiving a container thereon.

27. The file cabinet as defined in claim 25, wherein said base includes a hub for providing vertical support for the file cabinet.

28. The file cabinet as defined in claim 25, wherein each of said pivot arm assemblies includes:

a pivot tube having a first and a second end;

a bearing member disposed in said first and second ends of said pivot tube, each bearing member interconnected to one of said spiders:

a hanger arm extending from said pivot tube; and a member cooperating with said hanger arm to control a rotation angle of each pivot tube between said stowed position and said extended position.

29. The file cabinet as defined in claim 25, further comprising a plurality of tiers of said carrousel file assembly stacked upon one another and coupled to said base.

* * * * *